US009597784B2

(12) United States Patent
McClung

(10) Patent No.: US 9,597,784 B2
(45) Date of Patent: Mar. 21, 2017

(54) IMPACT TOOLS

(71) Applicant: Ingersoll-Rand Company, Davidson, NC (US)

(72) Inventor: Mark T. McClung, Andover, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 781 days.

(21) Appl. No.: 13/964,297

(22) Filed: Aug. 12, 2013

(65) Prior Publication Data

US 2015/0041163 A1 Feb. 12, 2015

(51) Int. Cl.
*B25B 21/02* (2006.01)

(52) U.S. Cl.
CPC ..... *B25B 21/02* (2013.01); *B25B 21/026* (2013.01)

(58) Field of Classification Search
CPC ..... B25B 21/00; B25B 21/02; B25B 21/026; B25B 21/008; B25B 23/14; B25B 23/141; B25B 23/1405; B25B 23/1475; B25B 23/1453; B25D 16/006; B25D 2216/0023; B23B 31/001; B23B 31/123; B23B 31/1253
USPC ..... 173/1, 93, 93.5, 93.6, 128, 176, 2, 179, 173/178, 47, 48, 109, 181, 183, 4, 104, 173/205; 81/429, 469; 73/862.23
See application file for complete search history.

(56) References Cited

U.S. PATENT DOCUMENTS 4,287,956 A 9/1981 Maurer
4,316,512 A * 2/1982 Kibblewhite ..... G01D 5/24404 173/183
5,457,866 A * 10/1995 Noda ..... B25B 21/026 173/183
6,167,606 B1 * 1/2001 Mueller ..... B23P 19/066 173/181
6,598,684 B2 7/2003 Watanabe
6,695,070 B1 * 2/2004 Gokturk ..... H02K 49/106 173/1
6,910,540 B2 * 6/2005 Totsu ..... B25B 23/14 173/178
6,918,449 B2 * 7/2005 Shinagawa ..... B25B 21/02 173/117
6,923,268 B2 * 8/2005 Totsu ..... B25B 21/00 173/170
6,945,337 B2 9/2005 Kawai et al.
6,968,908 B2 * 11/2005 Tokunaga ..... B25B 21/02 173/181
7,036,605 B2 * 5/2006 Suzuki ..... B25B 21/02 173/176
7,204,322 B2 4/2007 Sakai
(Continued)

*Primary Examiner* — Scott A. Smith
(74) *Attorney, Agent, or Firm* — Barnes & Thornburg LLP

(57) ABSTRACT

Illustrative embodiments of impact tools are disclosed. In at least one illustrative embodiment, an impact tool may comprise an impact mechanism including a hammer and an anvil. The hammer may be configured to rotate and to move between a disengaged position in which the hammer does not impact the anvil when rotating and an engaged position in which the hammer impacts the anvil when rotating, and the anvil may be configured to rotate when impacted by the hammer. The impact tool may further comprise an electronic controller configured to cause the hammer to (i) rotate in the disengaged position until reaching a threshold rotational speed and (ii) move from the disengaged position to the engaged position in response to the hammer achieving the threshold rotational speed.

20 Claims, 4 Drawing Sheets

(56) References Cited

U.S. PATENT DOCUMENTS 7,234,536 B2 * 6/2007 Scholl ..... B25B 23/14 173/1
7,419,013 B2 * 9/2008 Sainomoto ..... B25B 23/1405 173/104
7,428,934 B2 * 9/2008 Arimura ..... B25B 23/1475 173/104
7,513,317 B2 4/2009 Satou
7,556,103 B2 * 7/2009 Matsunaga ..... B25B 23/141 173/176
7,562,720 B2 7/2009 Seith et al.
7,588,097 B2 9/2009 Kamegai et al.
7,607,492 B2 * 10/2009 Seith ..... B25B 21/026 173/1
7,677,844 B2 * 3/2010 Schell ..... B23B 31/1253 279/125
7,681,659 B2 * 3/2010 Zhang ..... B23D 59/001 173/1
7,886,840 B2 2/2011 Young et al.
7,967,078 B2 6/2011 Aoki
8,091,650 B2 * 1/2012 Van der Linde ..... B23B 31/001 173/170
8,505,649 B2 * 8/2013 Scrimshaw ..... B23B 31/123 173/176
8,678,106 B2 * 3/2014 Matsunaga ..... B25B 21/008 173/176
8,944,179 B2 * 2/2015 Ukai ..... B25B 21/008 173/178
9,289,886 B2 * 3/2016 Limberg ..... B25B 21/026
2002/0020538 A1 * 2/2002 Giardino ..... B25B 23/1405 173/176
2003/0149508 A1 * 8/2003 Watanabe ..... B25B 23/1405 700/168
2005/0263304 A1 * 12/2005 Sainomoto ..... B25B 23/1405 173/2
2006/0185869 A1 * 8/2006 Arimura ..... B25B 23/1475 173/176
2007/0000676 A1 * 1/2007 Arimura ..... B25B 21/02 173/179
2007/0210733 A1 * 9/2007 Du ..... H02K 1/278 318/268
2009/0195204 A1 8/2009 Gumpert
2010/0071923 A1 * 3/2010 Rudolph ..... B25B 21/00 173/48
2012/0199372 A1 8/2012 Nishikawa et al.
2012/0222876 A1 * 9/2012 Schmidt ..... B25B 21/02 173/1
2012/0279736 A1 11/2012 Tanimoto et al.
2013/0008679 A1 1/2013 Nishikawa et al.
2013/0014967 A1 1/2013 Ito et al.
2013/0025892 A1 1/2013 Mashiko et al.

* cited by examiner

IMPACT TOOLS

TECHNICAL FIELD

The present disclosure relates, generally, to impact tools and, more particularly, to impact tools having controlled blow impact mechanisms.

BACKGROUND

An impact wrench is one illustrative embodiment of an impact tool, which may be used to install and remove threaded fasteners. An impact wrench generally includes a motor coupled to an impact mechanism that converts the torque of the motor into a series of powerful rotary blows directed from one or more hammers to an output shaft called an anvil. In typical impact mechanisms, the timing of these rotary blows is mechanically dependent on the rotational motion of the hammer(s).

SUMMARY

According to one aspect, an impact tool may comprise an impact mechanism including a hammer and an anvil, where the hammer is configured to rotate and to move between a disengaged position in which the hammer does not impact the anvil when rotating and an engaged position in which the hammer impacts the anvil when rotating and where the anvil is configured to rotate when impacted by the hammer, and an electronic controller configured to cause the hammer to rotate in the disengaged position until reaching a threshold rotational speed and to move from the disengaged position to the engaged position in response to the hammer achieving the threshold rotational speed.

In some embodiments, the hammer may be configured to move along an axis between the disengaged position and the engaged position. Each of the hammer and the anvil may be configured to rotate about the axis. The electronic controller may be configured to actuate a solenoid valve to cause the hammer to move from the disengaged position to the engaged position. The electronic controller may be further configured to receive user input and modify the threshold rotational speed based on the user input. The impact tool may further comprise a mechanical spring configured to bias the hammer toward the disengaged position.

According to another aspect, a method of operating an impact tool with independent rotational and translational hammer motion may comprise rotating a hammer of an impact tool about an axis in a disengaged position in which the hammer does not impact an anvil of the impact tool, measuring a rotational speed of the hammer about the axis, and moving the hammer from the disengaged position to an engaged position to impact the anvil in response to the rotational speed of the hammer achieving a threshold rotational speed.

In some embodiments, moving the hammer from the disengaged position to the engaged position may comprise moving the hammer along the axis from the disengaged position to the engaged position. Moving the hammer from the disengaged position to the engaged position may comprise actuating a solenoid valve. The method may further comprise determining the threshold rotational speed as a function of a user input. The method may further comprise moving the hammer from the engaged position to the disengaged position in response to the hammer impacting the anvil. Moving the hammer from the engaged position to the disengaged position may comprise allowing a mechanical spring that biases the hammer toward the disengaged position to move the hammer.

According to yet another aspect, an impact tool may comprise an anvil, a hammer configured to impact the anvil when the hammer may be in an engaged position, a motor configured to drive rotation of the hammer to generate a threshold kinetic energy of the hammer, and an actuator configured to move the hammer from a disengaged position to the engaged position to impact the anvil in response to generation of the threshold kinetic energy.

In some embodiments, the motor may be configured to drive rotation of the hammer while in the disengaged position to generate the threshold kinetic energy of the hammer. The actuator may be configured to move the hammer from the disengaged position to the engaged position along an axis. The motor may be configured to drive rotation of the hammer about the axis. The impact tool may further comprise a user interface configured to receive user input and modify the threshold kinetic energy based on the user input. The impact tool may further comprise a speed sensor coupled to a rotor of the motor and configured sense a rotational speed of the rotor and an electronic circuit configured to determine a kinetic energy of the hammer based on the sensed rotational speed of the rotor. The rotor may comprise a first end coupled to the hammer, a second end coupled to the speed sensor, and a plurality of fins positioned between the first and second ends. The actuator may be configured to move the hammer from the disengaged position to the engaged position by diverting motive fluid from the motor to a piston coupled to the hammer.

BRIEF DESCRIPTION

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

While the concepts of the present disclosure are susceptible to various modifications and alternative forms, specific exemplary embodiments thereof have been shown by way of example in the figures and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 1A:
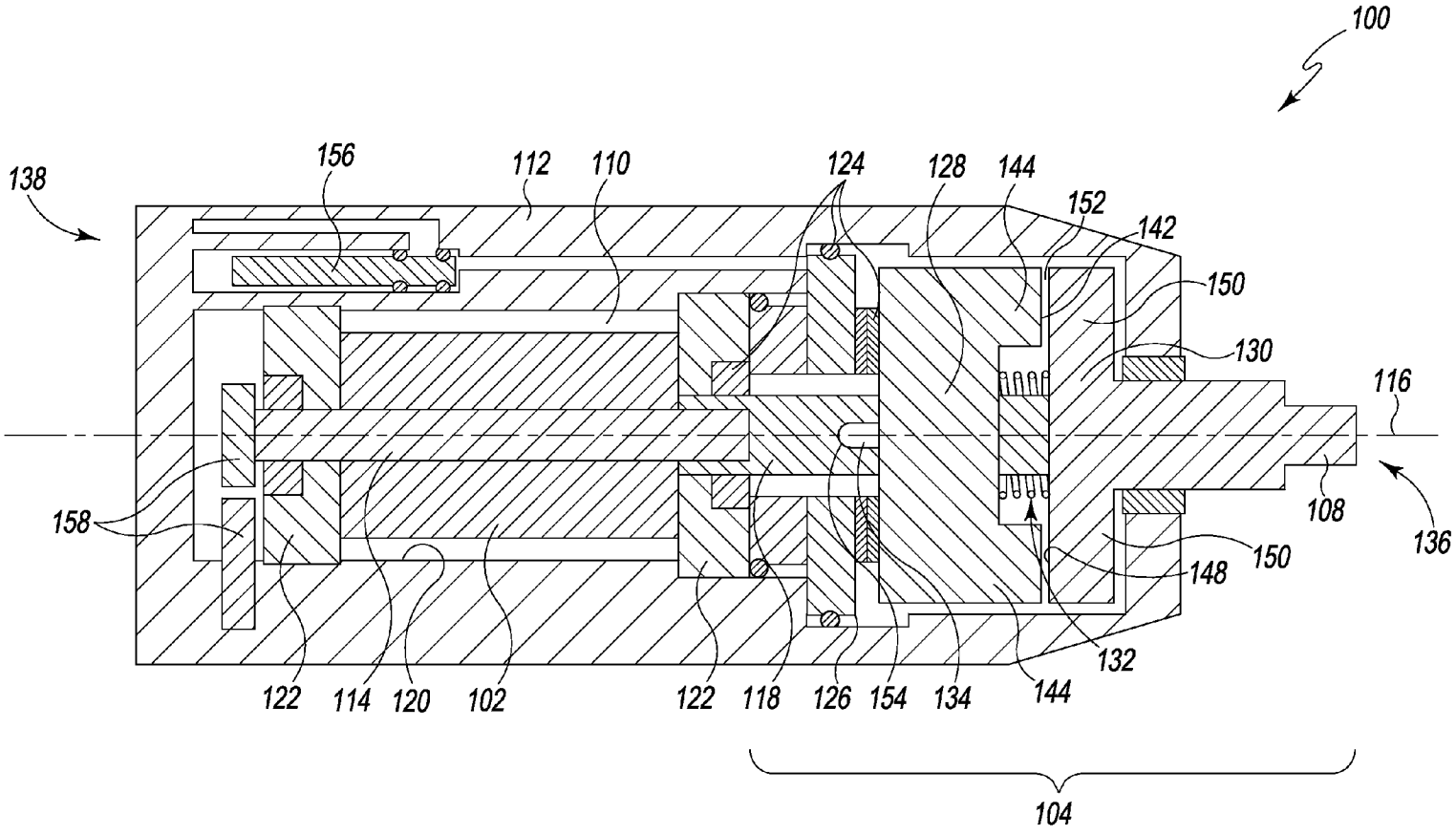
FIG. 1A is a partial cross-sectional view of one embodiment of an impact tool, showing a hammer of the impact tool in a disengaged position.
Figure 1B:
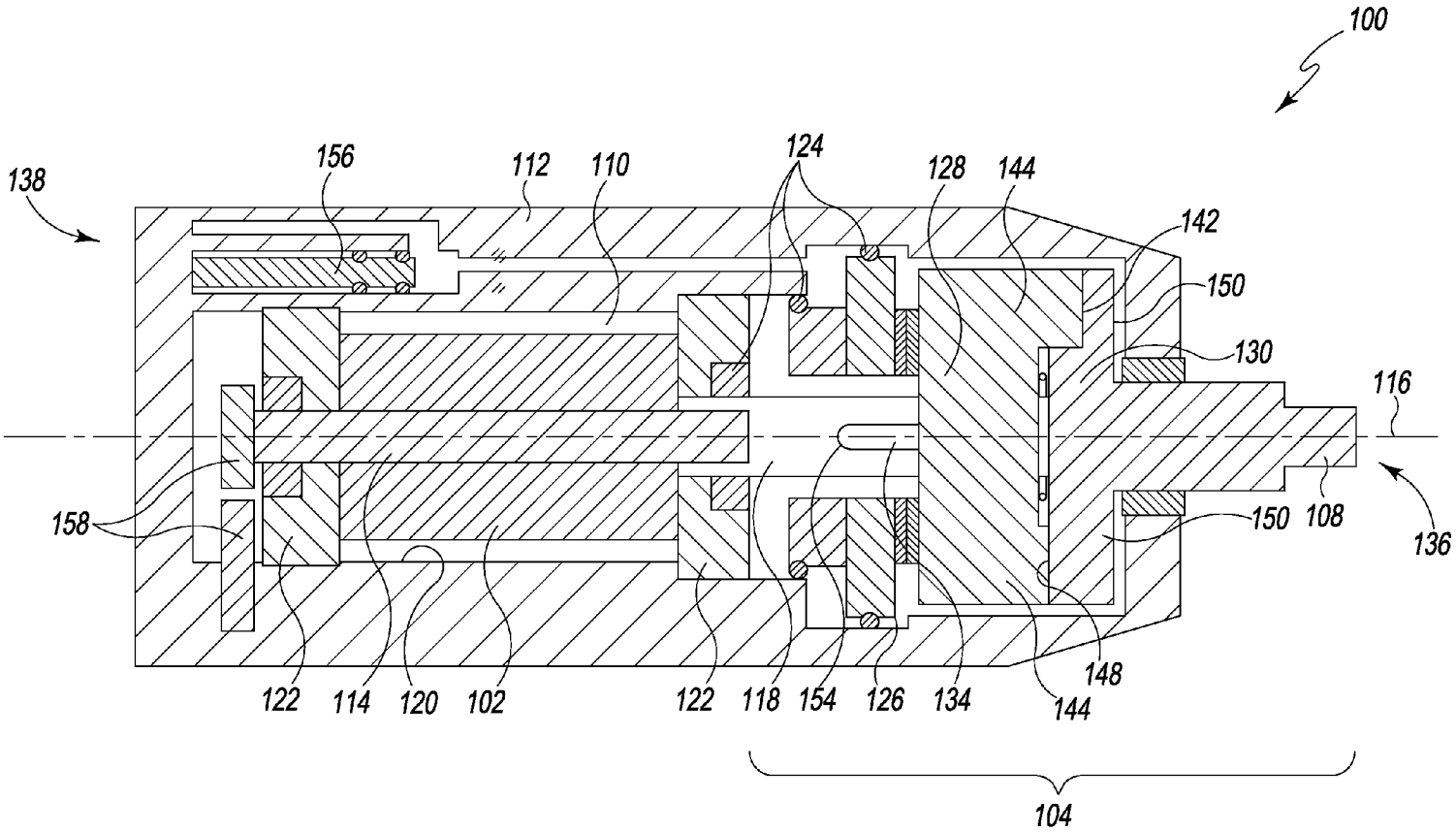
FIG. 1B is a partial cross-sectional view of the impact tool of FIG. 1A, showing the hammer in an engaged position.

Referring generally to FIGS. 1A-B, partial cross-sectional views of one illustrative embodiment of an impact tool 100 are shown. The impact tool 100 includes a motor 102 configured to drive rotation of an impact mechanism 104 and thereby drive rotation of an output shaft 108. The motor 102 is illustratively embodied as a pneumatically powered motor (i.e., an air motor) positioned within an internal cavity 110 of a housing 112 of the impact tool 100. In the illustrative embodiment of FIGS. 1A-B, the motor 102 is secured to an inner wall 120 of the housing 112 with motor endplates 122. The motor endplates 122 securely hold the motor 102 in place to prevent movement of the motor 102 within the internal cavity 110 of the housing 112 (e.g., from vibrations of the motor 102). It will be appreciated that, in other embodiments, other mechanisms for securing the motor 102 may be used. U.S. Pat. No. 7,886,840 to Young et al., the entire disclosure of which is hereby incorporated by reference, describes at least one embodiment of an air motor that may be used as the motor 102 of the impact tool 100. It is also contemplated that, in other embodiments of the impact tool 100, the motor 102 may be embodied as an electric motor.

The motor 102 includes a rotor 114 positioned along a longitudinal axis 116 of the impact tool 100. As illustratively shown, the longitudinal axis 116 extends from a front output end 136 of the impact tool 100 to a rear end 138 of the impact tool. In the illustrative embodiment of FIGS. 1A-B, one end of the rotor 114 is coupled to a cam shaft 118 such that rotation of the rotor 114 drives rotation of the cam shaft 118. For example, in some embodiments, the rotor 114 is taper fit to mate with the cam shaft 118. In other embodiments, another fastening mechanism may be implemented to secure the cam shaft 118 to the rotor 114 for rotation therewith. In still other embodiments, the rotor 114 and the cam shaft 118 may constitute a monolithic structure, rather than separate components secured to one another. In the illustrative embodiment, where the motor 102 is an air motor, the rotor 114 includes a plurality of fins that are configured to be driven by a supply of motive fluid (e.g., compressed air).

As shown in FIGS. 1A-B, the impact mechanism 104 generally includes the cam shaft 118, a number of bearings 124, a piston 126, a hammer 128, an anvil 130, and a mechanical spring 132. The cam shaft 118 passes through an opening in the hammer 128 (e.g., at the center of the hammer 128) and drives rotation of the hammer 128. The cam shaft 118 includes an axial groove 134 defined longitudinally therein and configured to fit a corresponding structure of the hammer 128. For example, the contour of the axial groove 134 may match a corresponding contour of a protrusion extending radially inward from the hammer 128. The axial groove 134 permits the hammer 128 to move freely along the longitudinal axis 116 of the impact tool 100, independent of the rotational motion of the hammer 128.

In the illustrative embodiment, the piston 126 has a generally annular shape and is coupled to the hammer 128 via one or more bearings 124 that allow rotation of the hammer 128 relative to the piston 126. The piston 126 is configured to move axially along the longitudinal axis 116 within the housing 112 in response to a motive fluid being applied to the piston 126. A number of bearings 124 are configured to support the piston 126 for translational movement along the longitudinal axis 116. It will be appreciated that the shape, location, and number of the bearings 124 may vary depending on the particular embodiment. For example, the bearings 124 may include ball bearings configured to be received in corresponding recesses formed in the housing 112.

The hammer 128 is rotatable about the longitudinal axis 116 and is configured to impact the anvil 130 (when in the engaged position shown in FIG. 1B), thereby driving rotation of the anvil 130 about the longitudinal axis 116. In some embodiments, the anvil 130 may be integrally formed with the output shaft 108. In other embodiments, the anvil 130 and the output shaft 108 may be formed separately and coupled to one another. In such embodiments, the output shaft 108 is configured to rotate as a result of corresponding rotation of the anvil 130. The output shaft 108 may be configured to mate with a socket (e.g., for use in tightening and loosening fasteners, such as bolts). Although the output shaft 108 is shown as a square drive output shaft, the principles of the present disclosure may be applied to an output shaft of any suitable size and shape. The motor 102 and the impact mechanism 104, which includes the hammer 128 and the anvil 130, are adapted to rotate the output shaft 108 in both clockwise and counterclockwise directions, for tightening or loosening various fasteners.

The hammer 128 includes a forward impact face 142 facing the front output end 136 of the impact tool 100. A pair of lugs 144 extends forward from the forward impact face 142. Each of the lugs 144, which may be integrally formed with the hammer 128, includes an impact surface configured to impact a corresponding impact surface of the anvil 130. In some embodiments, the impact surfaces of the lugs 144 are generally perpendicular to the forward impact face 142 of the hammer 128 but, in other embodiments, the impact surface may be otherwise suitably shaped. Although the illustrative embodiment of the hammer 128 includes two lugs 144, any suitable number of lugs 144 may be utilized in other embodiments.

The anvil 130, which may be integrally formed with the output shaft 108, includes a rearward impact face 148 facing the rear end 138 of the impact tool 100. The rearward impact face 148 includes a pair of lugs 150 extending radially outwardly from the output shaft 108. Each of the lugs 150, which may be integrally formed with the anvil 130, includes an impact surface for receiving an impact blow from the lugs 144 of the hammer 128. The impact surface may be generally perpendicular to the rearward impact face 148 or otherwise shaped. While the illustrative embodiment of the anvil 130 includes two lugs 150, any suitable number of lugs 150 may be utilized.

The mechanical spring 132 is disposed around the cam shaft 118 between the hammer 128 and the anvil 130 to bias the hammer 128 away from the anvil 130. As shown in FIG. 1A, when the hammer 128 is not being driven toward the anvil 130 (i.e., toward an engaged position), the mechanical spring 132 biases the hammer 128 away from the anvil 130 (i.e., toward a disengaged position). In other words, the mechanical spring 132 moves the hammer 128 along the axial groove 134 of the cam shaft 118, toward the rear end 138 of the impact tool 100, to provide a clearance 152 between the hammer 128 and the anvil 130. The clearance 152 separates the lugs 144 of the hammer 128 from the lugs 150 of the anvil 130 so that the lugs 144, 150 do not contact one another, despite rotation of the hammer 128. As the hammer 128 is driven forward toward the anvil 130, as illustrated in FIG. 1B, the mechanical spring 132 is compressed (i.e., the biasing force is overcome), diminishing the clearance 152 and allowing the hammer lugs 144 to impact the anvil lugs 150 to transfer rotational torque from the hammer 128 to the anvil 130.

Upon impact, the hammer 128 will rebound and be biased away from the anvil 130 by the mechanical spring 132. In the illustrative embodiment, the axial groove 134 of the cam shaft 118 terminates at an end 154 thereby limiting the displacement of the hammer 128 toward the rear end 138 of the impact tool 100. In other words, the mechanical spring 132 may only bias the hammer 128 away from the anvil 130 as far as the end 154 of the axial groove 134. In some embodiments, the impact mechanism 104 may include other mechanisms for biasing or otherwise moving the hammer 128 away from the anvil 130 upon impact and may include other mechanisms for limiting axial displacement of the hammer 128 toward the rear end 138 of the impact tool 100. For example, as shown in FIG. 1A, the piston 126 may also seat against one of the motor endplates 122 to limit axial displacement of the hammer 128 toward the rear end 138 of the impact tool 100.

In the illustrative embodiment shown in FIGS. 1A-B, the impact tool 100 further includes a valve 156, which is configured to control the flow of motive fluid. The valve 156 is configured to move between a first position (shown in FIG. 1A) in which motive fluid is supplied solely to the motor 102 to drive rotation of the rotor 114 and a second position (shown in FIG. 1B) in which motive fluid is at least partially diverted from the motor 102 to drive axial movement of the piston 126. As such, the valve 156 and the piston 126 together act as a pneumatic actuator to move the hammer 128 from a disengaged position to an engaged position to impact the anvil 130. The valve 156 may be embodied as any suitable type of valve, such as an electronically controlled solenoid valve.

In other embodiments (e.g., in embodiments in which an electric motor is used to drive rotation of the hammer 128), the impact tool 100 may include a mechanical or electromechanical actuator, which may be formed with or coupled to the cam shaft 118, to drive movement of the hammer 128 along the longitudinal axis 116 toward the anvil 130. In such embodiments, the actuator may additionally move the hammer 128 away from the anvil 130, without a need for the mechanical spring 132. Although the hammer 128 has been discussed above as traveling along the longitudinal axis 116 to impact the anvil 130, it is contemplated that the hammer 128 may travel along a different trajectory in other embodiments. For example, the hammer 128 may translate along an arced path (e.g., via hinged actuation) in order to impact the anvil 130.

The impact tool 100 also includes one or more sensors 158 configured to sense, directly or indirectly, a rotational speed of the hammer 128. As shown in the illustrative embodiment of FIGS. 1A-B, one or more the sensors 158 may be coupled to an end of the rotor 114 opposite the end coupled to the camshaft 118 and the hammer 128. It will be appreciated that, in other embodiments, the sensors 158 may be positioned elsewhere in the impact tool 100. In the illustrative embodiment, the sensors 158 are configured to sense data that may be used by an electronic controller 202 of the impact tool 100 to determine when to drive the hammer 128 toward the anvil 130. Accordingly, the sensors 158 may be configured to sense, for example, the rotational speed that various components of the impact tool 100 are traveling (e.g., the hammer 128, the cam shaft 118, or the rotor 114). As such, the sensors 158 may include, for example, proximity sensors, optical sensors, light sensors, motion sensors, and/or other types of sensors. It should be appreciated that the foregoing examples are merely illustrative and should not be seen as limiting the sensors 158 to any particular type of sensor. As discussed below, once a threshold rotational speed of the hammer 128 has been achieved, the controller 202 may instruct the actuator (e.g., via electrical signals sent to valve 156) to move the hammer 128 from the disengaged position to the engaged position to impact the anvil 130.

Figure 2:
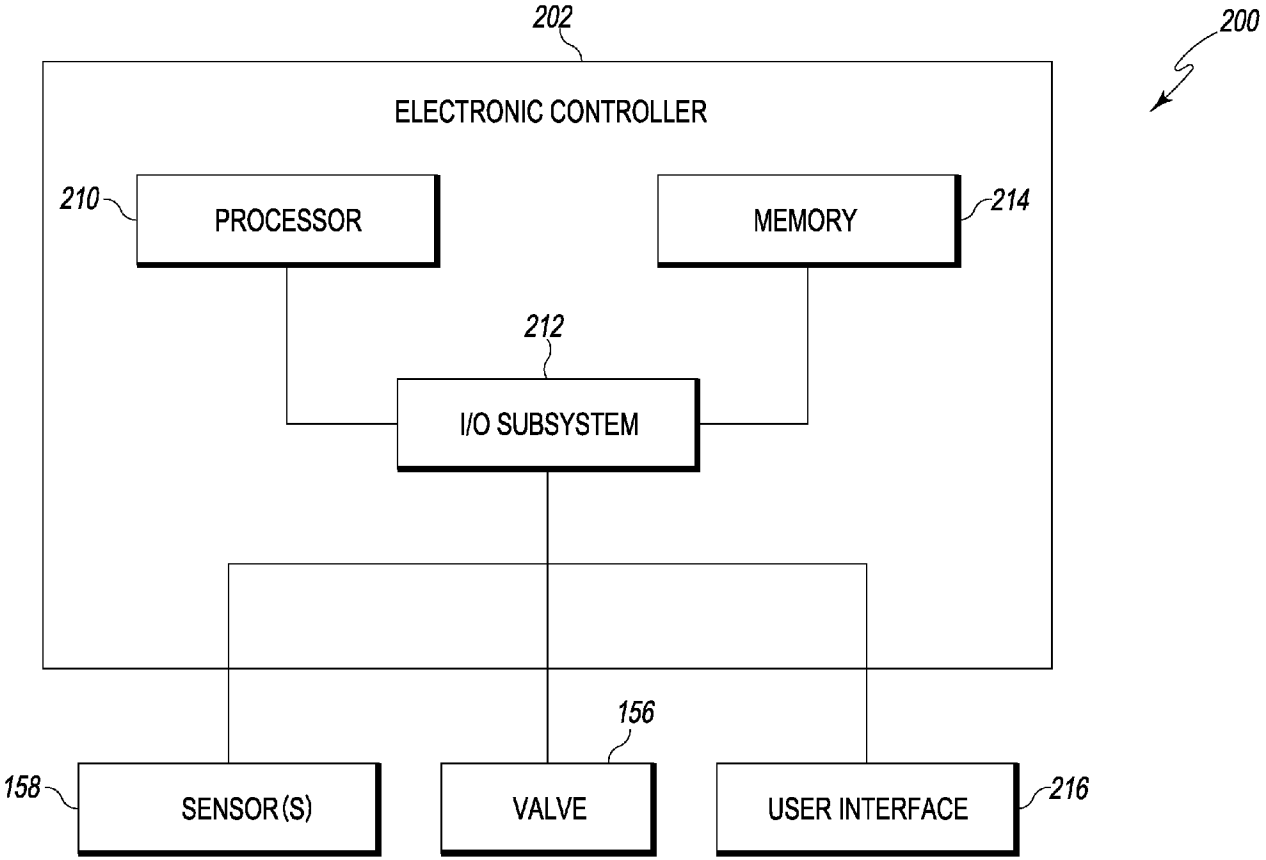
FIG. 2 is a simplified block diagram of one embodiment of a control system of the impact tool of FIGS. 1A-B.

Referring now to FIG. 2, the impact tool 100 includes an electronic control system 200. It should be appreciated that certain mechanical and electromechanical components of the impact tool 100 are not shown in FIG. 2 for clarity. The control system 200 generally includes an electronic controller 202, the valve 156, the sensor(s) 158, and a user interface 216. In the illustrative embodiment, the electronic controller 202 constitutes part of the impact tool 100 and is communicatively coupled to the valve 156, the sensor(s) 158, and the user interface 216 of the impact tool 100 via one or more wired connections. In other embodiments, the controller 202 may be separate from the impact tool 100 and/or may be communicatively coupled to the valve 156, the sensor(s) 158, and the user interface 216 via other types of connections (e.g., wireless or radio links). The controller 202 is, in essence, the master computer responsible for interpreting signals sent by the sensor(s) 158 and the user interface 216 of the impact tool 100 and for activating or energizing electronically-controlled components associated with the impact tool 100. For example, the controller 202 is configured to monitor various signals from the sensor(s) 158 and the user interface 216, to control operation of the valve 156, and to determine when various operations of the impact tool 100 should be performed, amongst many other things. In particular, as will be described in more detail below with reference to FIG. 3, the controller 202 is operable to identify when to move the hammer 128 from the disengaged position to the engaged position to impact the anvil 130.

To do so, the controller 202 includes a number of electronic components commonly associated with electronic controllers utilized in the control of electromechanical systems. In the illustrative embodiment, the controller 202 of the impact tool 100 includes a processor 210, an input/output ("I/O") subsystem 212, and a memory 214. It will be appreciated that the controller 202 may include additional or different components, such as those commonly found in a computing device. Additionally, in some embodiments, one or more of the illustrative components of the controller 202 may be incorporated in, or otherwise form a portion of, another component of the controller 202 (e.g., as with a microcontroller).

The processor 210 of the controller 202 may be embodied as any type of processor(s) capable of performing the functions described herein. For example, the processor 210 may be embodied as one or more single or multi-core processors, digital signal processors, microcontrollers, or other processors or processing/controlling circuits. Similarly, the memory 214 may be embodied as any type of volatile or non-volatile memory or data storage device capable of performing the functions described herein. The memory 214 stores various data and software used during operation of the controller 202, such as operating systems, applications, programs, libraries, and drivers. For instance, the memory 214 may store instructions in the form of a software routine (or routines) which, when executed by the processor 210, allows the controller 202 to control operation of the impact tool 100.

The memory 214 is communicatively coupled to the processor 210 via the I/O subsystem 212, which may be embodied as circuitry and/or components to facilitate I/O operations of the controller 202. For example, the I/O subsystem 212 may be embodied as, or otherwise include, memory controller hubs, I/O control hubs, firmware devices, communication links (e.g., point-to-point links, bus links, wires, cables, light guides, printed circuit board traces, etc.), and/or other components and subsystems to facilitate the I/O operations. In the illustrative embodiment, the I/O subsystem 212 includes an analog-to-digital ("A/D") converter, or the like, that converts analog signals from the sensors 158 of the impact tool 100 into digital signals for use by the processor 210. It should be appreciated that, if any one or more of the sensors associated with the impact tool 100 generate a digital output signal, the A/D converter may be bypassed. Similarly, in the illustrative embodiment, the I/O subsystem 212 includes a digital-to-analog ("D/A") converter, or the like, that converts digital signals from the processor 210 into analog signals for use by the valve 156 of the impact tool 100. It should also be appreciated that, if the valve 156 operates using a digital input signal, the D/A converter may be bypassed.

The user interface 216 is also communicatively coupled to the processor 210 via the I/O subsystem 212. The user interface 216 permits a user to interact with the controller 202 to, for example, control operation of the motor 102 and/or modify a threshold value (e.g., threshold rotational speed or kinetic energy of the hammer 128) at which the hammer 128 should be moved from the disengaged position to the engaged position to impact the anvil 130. As such, in some embodiments, the user interface 216 includes a keypad, a touch screen, a display, switches, knobs, and/or other mechanisms to permit I/O functionality.

Figure 3:
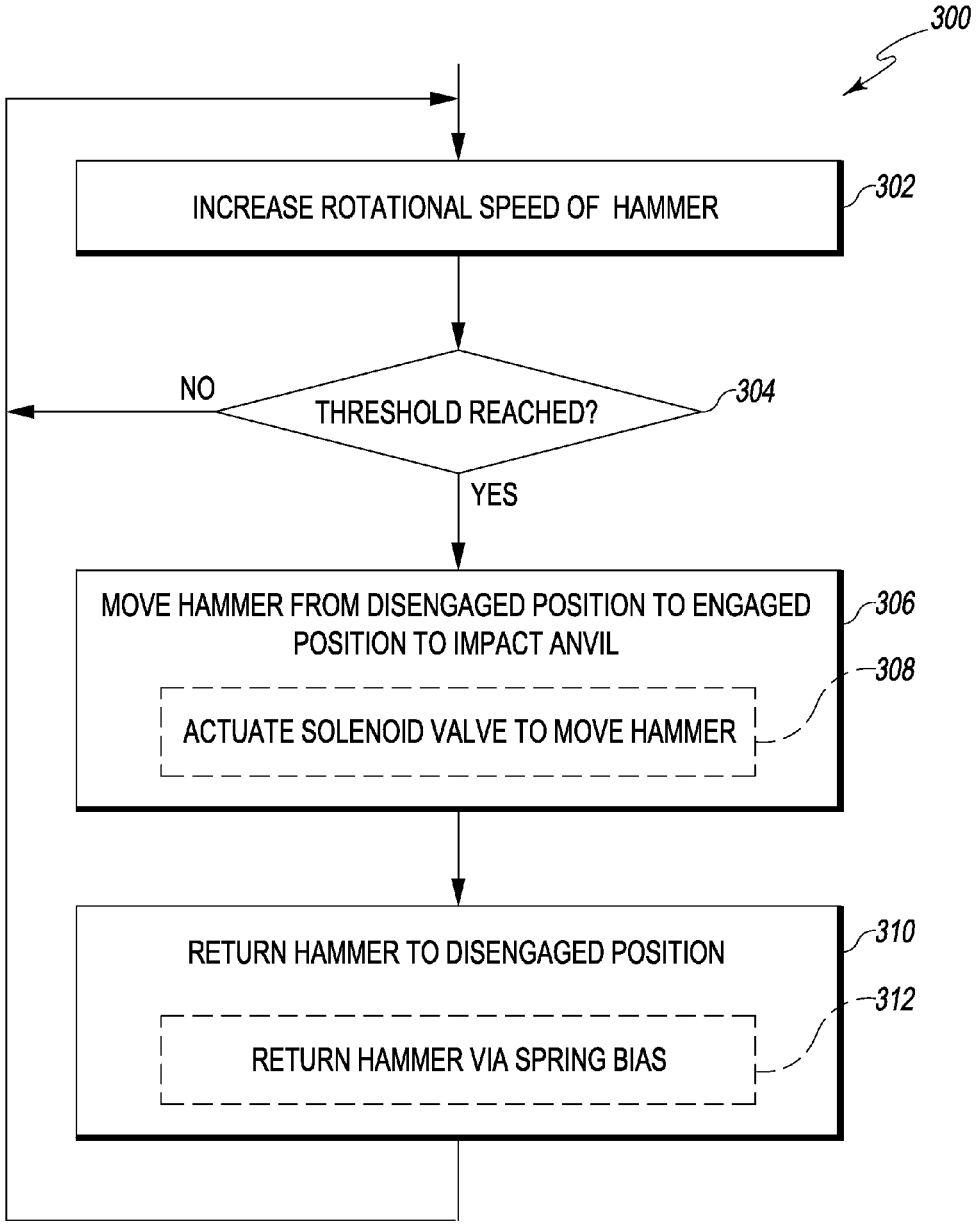
FIG. 3 is a simplified block diagram of one embodiment of a method for controlling the impact tool of FIGS. 1A-B.

Referring now to FIG. 3, one illustrative embodiment of a method 300 of operating the impact tool 100 of FIGS. 1A-B is shown as a simplified flow diagram. The method 300 represents one illustrative embodiment of operating an impact tool 100 in which the hammer 128 is capable of independent rotational and translational motion. The method 300 is illustrated in FIG. 3 as a number of blocks 302-312, which may be performed by various components of the impact tool 100 or, more specifically, of the control system 200 described above with reference to FIG. 2.

The method 300 begins with block 302 in which the impact tool 100 increases the rotational speed of the hammer 128. In some embodiments, block 302 may be performed in response to such an instruction from the controller 202. As described above, the motor 102 drives rotation of the hammer 128 via the cam shaft 118. The controller 202 may transmit a control signal to the motor 102 to begin rotation of the hammer 128 in response to user input (e.g., a user holding a trigger of the impact tool 100). Additionally, as described herein, the controller 202 may cause the speed of the hammer 128 to be increased in response to determining that the hammer 128 is in a disengaged position (i.e., the clearance 152 is present between the hammer 128 and the anvil 130, as shown in FIG. 1A) and that a threshold value (e.g., a threshold rotational speed of the hammer 128) has not yet been achieved.

After block 302, the method 300 proceeds to block 304 in which the controller 202 determines whether a particular threshold value for an attribute of the hammer 128 has been achieved. The particular attribute and value defining the threshold value may vary depending on the particular embodiment and the particular sensors 158 used. For example, in an embodiment in which the sensors 158 are used to determine the rotational speed of the hammer 128, the controller 202 may compare the sensed speed values to a threshold rotational speed to determine whether the threshold rotational speed has been achieved (i.e., met or exceeded). It will be appreciated that sensed values may be used to derive other values that may be compared to a threshold. For instance, the controller 202 may use the sensed rotational speed of the hammer 128 to derive a kinetic energy of the hammer 128, which may then be compared to a desired kinetic energy as the threshold value. Additionally, in some embodiments, a user of the impact tool 100 may set or otherwise modify the threshold value to be used, via the user interface 216.

If the controller 202 determines in block 304 that the threshold value has not been reached, block 304 may involve the controller 202 returning the method 300 to block 302. As such, in the illustrative embodiment of FIG. 3, blocks 302, 304 will be repeated until the threshold value has been reached. If the controller 202 instead determines in block 304 that the threshold value has been reached, the method 300 proceeds to block 306 in which the impact tool 100 moves the hammer 128 from the disengaged position to the engaged position to deliver an impact to the anvil 130. In particular, block 306 may involve block 308 in which the controller 202 transmits a signal to the valve 156 of the impact tool 100, providing motive fluid to the piston 126 to move the hammer 128 along the longitudinal axis 116. In other embodiments, block 306 may involve the controller 202 transmitting a signal to an electromechanical actuator to move the hammer 128 from the disengaged position to the engaged position.

After block 306, the method 300 proceeds to block 310 in which the impact tool 100 returns the hammer 128 to the disengaged position. In particular, block 310 may involve block 312 in which the hammer 128 is returned to the disengaged position by virtue of the mechanical spring 132. As discussed above in reference to FIGS. 1A-B, the mechanical spring 132 biases the hammer 128 away from the anvil 130 toward the rear end 138 of the impact tool 100. After rebounding from impact with the anvil 130, the hammer 128 is moved (i.e., via the spring bias) from the engaged position to the disengaged position in which there is clearance 152 between the hammer 128 and the anvil 130. More specifically, air may be supplied to engage the hammer 128 with the anvil 130. Upon impact, the controller 202 may transmit a signal to the electromechanical actuator (i.e., to energize or de-energize the actuator, depending on the particular embodiment) to cause air to be vented and evacuated from the piston 126, thereby allowing the mechanical spring 132 to disengage the hammer 128 from the anvil 130 via mechanical bias.

In other embodiments, block 310 may involve the controller 202 transmitting a signal to an electromechanical actuator to move the hammer 128 from the engaged position to the disengaged position. In yet another embodiment, the piston 126 may be embodied as a double action air piston. In such an embodiment, the impact tool 100 need not include the mechanical spring 132. Rather, a control valve may shuttle air between both sides of the piston 126 such that, in one state, the air engages the piston 126 (e.g., to cause the hammer 128 to engage the anvil 130) and, in the other state, the air disengages the piston 126 (e.g., to cause the hammer to disengage the anvil 130). In some embodiments, the mechanical spring 132 may be positioned at the rear end of the hammer 128 and configured to bias the hammer 128 toward the anvil 130 (i.e., toward the engaged position). In such embodiments, air may be supplied to overcome the spring bias and to cause the hammer 128 to disengage the anvil 130. It should be appreciated that the hammer 128 may engage and disengage the anvil 130 in another way and/or using another mechanism and may do so using, for example, an electric or air powered actuator. After block 310, the method 300 returns to block 302. It is contemplated that the method 300 may be repeated rapidly for tightening or loosening a fastener using the impact tool 100.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An impact tool comprising:

an impact mechanism including a hammer and an anvil, the hammer configured to rotate and to move between a disengaged position in which the hammer does not impact the anvil when rotating and an engaged position in which the hammer impacts the anvil when rotating, the anvil configured to rotate when impacted by the hammer; and an electronic controller configured to cause the hammer to (i) rotate in the disengaged position until reaching a threshold rotational speed and (ii) move from the disengaged position to the engaged position in response to the hammer achieving the threshold rotational speed.

2. The impact tool of claim 1, wherein the hammer is configured to move along an axis between the disengaged position and the engaged position.

3. The impact tool of claim 2, wherein each of the hammer and the anvil is configured to rotate about the axis.

4. The impact tool of claim 1, wherein the electronic controller is configured to actuate a solenoid valve to cause the hammer to move from the disengaged position to the engaged position.

5. The impact tool of claim 1, wherein the electronic controller is further configured to receive user input and modify the threshold rotational speed based on the user input.

6. The impact tool of claim 1, further comprising a mechanical spring configured to bias the hammer toward the disengaged position.

7. A method of operating an impact tool with independent rotational and translational hammer motion, the method comprising:

rotating a hammer of an impact tool about an axis in a disengaged position in which the hammer does not impact an anvil of the impact tool;

measuring a rotational speed of the hammer about the axis; and moving the hammer from the disengaged position to an engaged position to impact the anvil in response to the rotational speed of the hammer achieving a threshold rotational speed.

8. The method of claim 7, wherein moving the hammer from the disengaged position to the engaged position comprises moving the hammer along the axis from the disengaged position to the engaged position.

9. The method of claim 7, wherein moving the hammer from the disengaged position to the engaged position comprises actuating a solenoid valve.

10. The method of claim 7, further comprising determining the threshold rotational speed as a function of a user input.

11. The method of claim 7, further comprising moving the hammer from the engaged position to the disengaged position in response to the hammer impacting the anvil.

12. The method of claim 11, wherein moving the hammer from the engaged position to the disengaged position comprises allowing a mechanical spring that biases the hammer toward the disengaged position to move the hammer.

13. An impact tool comprising:

an anvil;

a hammer configured to impact the anvil when the hammer is in an engaged position;

a motor configured to drive rotation of the hammer to generate a threshold kinetic energy of the hammer; and an actuator configured to move the hammer from a disengaged position to the engaged position to impact the anvil in response to generation of the threshold kinetic energy.

14. The impact tool of claim 13, wherein the motor is configured to drive rotation of the hammer while in the disengaged position to generate the threshold kinetic energy of the hammer.

15. The impact tool of claim 13, wherein the actuator is configured to move the hammer from the disengaged position to the engaged position along an axis.

16. The impact tool of claim 15, wherein the motor is configured to drive rotation of the hammer about the axis.

17. The impact tool of claim 13, further comprising a user interface configured to receive user input and modify the threshold kinetic energy based on the user input.

18. The impact tool of claim 13, further comprising:

a speed sensor coupled to a rotor of the motor and configured sense a rotational speed of the rotor; and an electronic circuit configured to determine a kinetic energy of the hammer based on the sensed rotational speed of the rotor.

19. The impact tool of claim 18, wherein the rotor comprises a first end coupled to the hammer, a second end coupled to the speed sensor, and a plurality of fins positioned between the first and second ends.

20. The impact tool of claim 13, wherein the actuator is configured to move the hammer from the disengaged position to the engaged position by diverting motive fluid from the motor to a piston coupled to the hammer.

* * * * *